US006799530B1

(12) United States Patent
Heichelbech

(10) Patent No.: US 6,799,530 B1
(45) Date of Patent: Oct. 5, 2004

(54) ROTATABLE FLAGPOLE APPARATUS

(76) Inventor: Silas A. Heichelbech, 1915 Northview Dr., Ferdinand, DuBois County, IN (US) 47706

( * ) Notice: Subject to any disclaimer, the term of this patent is extended or adjusted under 35 U.S.C. 154(b) by 0 days.

(21) Appl. No.: 10/434,606

(22) Filed: May 12, 2003

(51) Int. Cl.[7] ..... G09F 17/00
(52) U.S. Cl. ..... 116/174; 248/511
(58) Field of Search ..... 116/173, 174, 116/28 R; 40/218, 607.01, 484, 493, 506; 248/511, 289.11, 291.1, 514, 516

(56) References Cited

U.S. PATENT DOCUMENTS 1,225,608 A * 5/1917 Freeman, Jr. ..... 248/289.11
2,711,712 A * 6/1955 Reed, Jr. ..... 116/174
3,587,520 A * 6/1971 Miller ..... 116/173
4,488,431 A * 12/1984 Miga ..... 73/170.08
4,727,822 A * 3/1988 Wikkerink ..... 116/174
5,615,635 A * 4/1997 Deviney ..... 116/173
5,904,116 A * 5/1999 Wyner et al. ..... 116/173
6,079,350 A * 6/2000 Parker ..... 116/173
6,129,035 A * 10/2000 Schweinberger ..... 116/28 R
6,422,913 B1 * 7/2002 Trejo ..... 446/217

* cited by examiner

*Primary Examiner*—Christopher W. Fulton
(74) *Attorney, Agent, or Firm*—Gary K. Price, Esq.

(57) ABSTRACT

A rotatable flagpole apparatus comprising a sleeve, an end cap, a collar, and means for attaching the flag to the sleeve. A flagpole extends within the sleeve, the flagpole having an end member defining a shoulder that is adjacent to a top edge of the sleeve so that the sleeve is rotatably supported by said end member. The sleeve of the apparatus and the flag attached thereto rotates about the stationary flagpole to permit the flag to be parallel with the wind. This reduces the tendency of the flag to wrap itself around the flagpole.

16 Claims, 2 Drawing Sheets

ROTATABLE FLAGPOLE APPARATUS

CROSS REFERENCES TO RELATED APPLICATIONS

None.

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates generally to flagpoles, which are used to display flags or banners in an elevated, prominent position for visual observation. More particularly, this invention relates to an improved rotatable flagpole apparatus in which the flag and the flagpole freely rotate following the wind direction in order to avoid the flag from being wrapped around the pole.

2. Brief Description of Prior Art

Pole arrangements for supporting flags or light banners are widely known and are used in various environments for different purposes in the United States and throughout the world. One very common type of flagpole arrangement is one wherein a relatively rigid pole is fixedly secured to the side of a structure, such a residence, and upwardly extends from the structure. Such flagpole is generally temporarily mounted and is easily removed.

One problem which plagues prior art flagpoles described above is that the flag or banner may wrap itself around the pole when the wind changes direction. In order to resolve this problem, flagpole arrangements have been developed which incorporate a bearing structure to permit rotation of the pole. This is a relatively costly, and uneconomical means of achieving the particular objective of preventing the flag from wrapping itself around the pole.

As designs for conventional and rotatable flagpole arrangements continue to evolve, it is recognized that improvements in economy of construction, functional efficiency and design, as well as improvements in appearance and visual effect are desirable singly in unvarying degrees with each other.

U.S. Pat. No. 3,595,202, is one prior art patent that shows the use of bearings to allow a rotational motion that will unfurl a flag wrapped around a pole. This arrangement is unnecessarily complex and expensive to manufacture. Further, ball bearings and similar arrangements require frequent maintenance particularly when used outdoors. Without maintenance the lubrication in the device dries out and the device quits working.

U.S. Pat. No. 5,870,968 discloses a flag unfurling device having a plurality of sleeves 36, 37 rotatably supported on a number of bearing surfaces 31, 32, 33, 34 as well as a number of fixed collars and sleeves. This arrangement creates and undesirable amount of drag between the fixed and rotating elements because of the amount of drag surface.

As will be seen from the subsequent description, the preferred embodiments of the present invention overcome shortcomings of the prior art.

SUMMARY OF THE INVENTION

The present invention is a rotatable flagpole apparatus. The flagpole apparatus being designed for preventing the flag or banner from wrapping itself around the pole when the wind changes direction. The rotatable flagpole apparatus generally includes a sleeve, an end cap, a collar, and a flagpole extending within the sleeve. The end cap and the collar are affixed to the outer surface of the sleeve. The flagpole apparatus further includes an end member defining a shoulder, the end member slidably received within the top end of the flagpole, and positioned within the end cap. A top edge of the sleeve abuts the shoulder of the end member when received within the top end of the flagpole. The sleeve and the cap fit in loose communication with the flagpole so that the sleeve rotates in response to wind force on an attached flag. The flag is attached to the flagpole apparatus by first and second eye screws. The first eye screw is threadably received within an opening in the end cap, and preferably extends through the opening of the end cap and threadably connects the end cap to the sleeve. The second eye screw is threadably received within an opening of the collar. The second eye screw extends through the opening of the collar and threadably connects the collar to the sleeve. The sleeve, end cap, and collar tend to rotate in response to wind force on an attached flag, in order to permit the flag to rotate in aligned parallel relationship with the wind. This reduces the tendency of the flag to wrap itself around the flagpole.

DESCRIPTION OF THE PREFERRED EMBODIMENT

Figure 1:
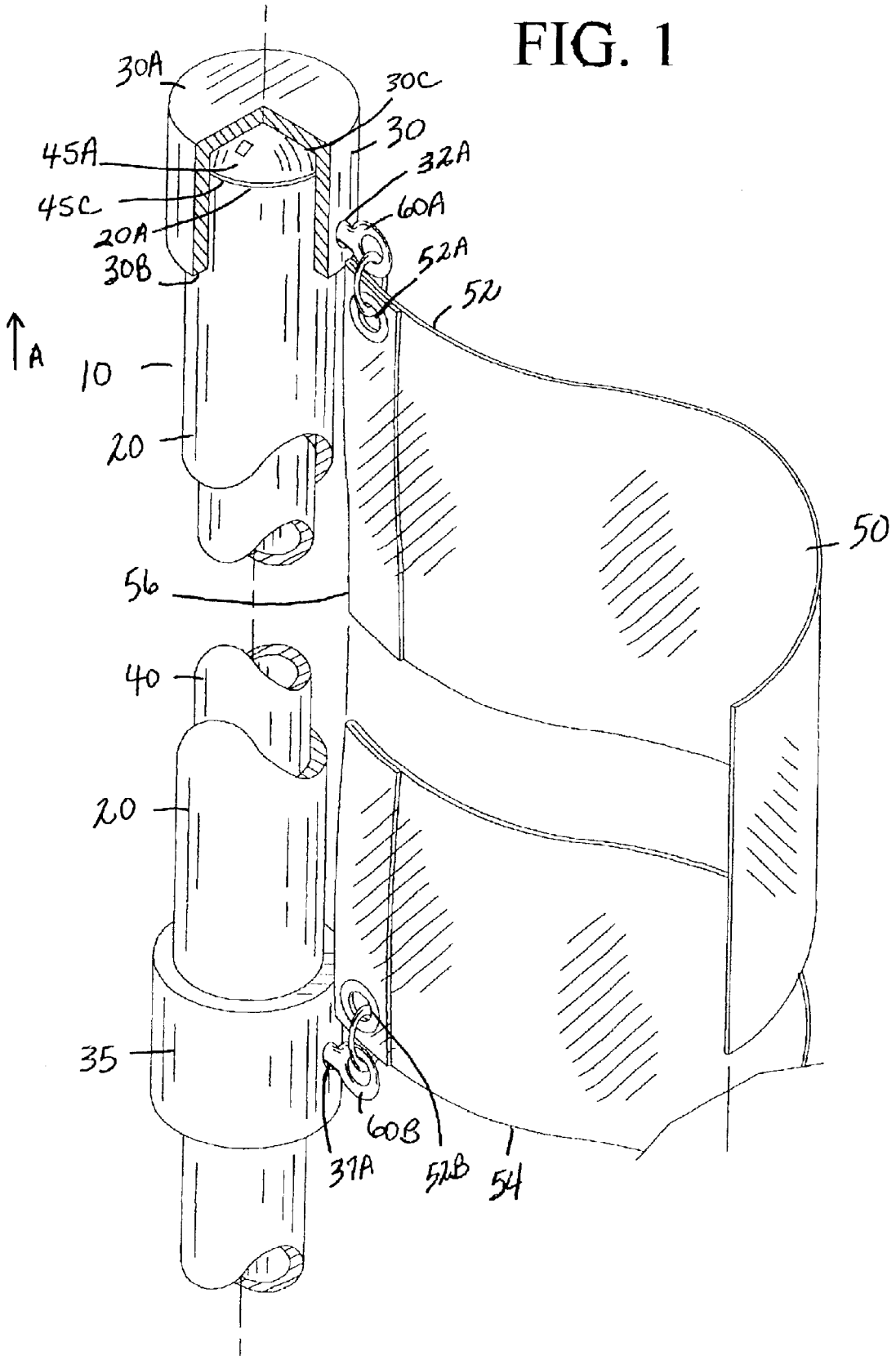
FIG. 1 is an exploded view of the rotatable flagpole apparatus according to an embodiment of the present invention.

In accordance with the present invention, a rotatable flagpole apparatus is disclosed. The rotatable flagpole apparatus of the present invention for use in preventing the flag from wrapping itself around the pole when the wind changes direction. Specifically, it will be noted in the drawings that the rotatable flagpole apparatus relates to an apparatus for holding a flag wherein the apparatus will respond to wind in such a manner as to keep the flag from being wrapped around the pole. In the broadest context, the rotatable flagpole apparatus consists of components configured and correlated with respect to each other so as to attain the desired objective.

Figure 2:
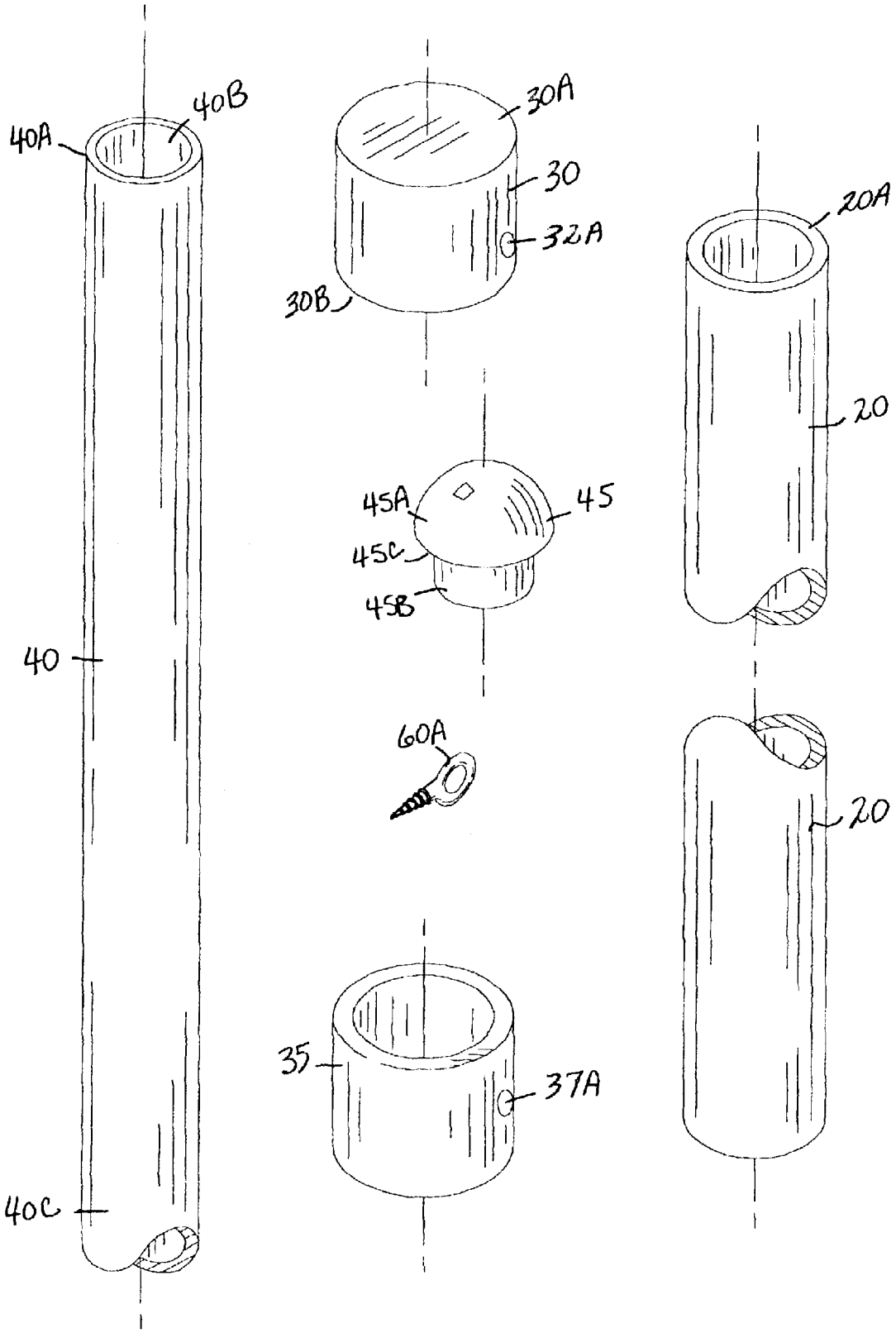
FIG. 2 illustrates elements of the rotatable flagpole apparatus of FIG. 1.

FIGS. 1–2, illustrate a preferred embodiment of a rotatable flagpole apparatus made in accordance of the present invention. As will be described, the rotatable flagpole apparatus generally for rotating with the direction of the wind in order to prevent the flag from wrapping itself around the pole.

Referring to the drawings, is disclosed a rotatable flagpole apparatus 10. The rotatable flagpole apparatus 10 includes a sleeve 20, an end cap 30, a collar 35, and eye screws 60A, 60B. As will be further described, the end cap 30 and the collar 35 are attached to the outer surface of the sleeve 20. The end cap 30 having an end surface 30A and an open end 30B opposite the end surface 30A. A flagpole 40 extends within the sleeve 20.

An end member 45 is attached to a top end 40A of the flagpole 40. In particular, the end member 45 having an upper portion 45A, and a lower portion 45B. The width of the upper portion 45A is greater than the width of the lower portion 45B defining a shoulder 45C. In application, the lower portion 45B is slidably received within an opening 40B of the top end 40A of the flagpole 40. In the preferred embodiment, the upper portion 45A of the end portion 45 is dome shaped, with its apex in communication with an interior surface 30C of the end surface 30A of the end cap 30. A lower end 40C of the flagpole 40 opposite the top end 40A is releasably secured to the ground, pole holder, or the side of a structure (not shown) by means known in the art.

The circumference of the shoulder 45C is slightly greater than the circumference of the sleeve 20 so that a top edge 20A of the sleeve 20 abuts the shoulder 45C of the end member 45 which is held in the flagpole 40. As such, the sleeve 20 is unable to separate from the flagpole 40 in the upward direction designated in FIG. 1 as arrow "A".

The end member 45 has a dome shape on the upper portion 45A. When the interior surface 30C of the cap 30 sits on the end member portion 45A it tends to form nearly a single point of contact near the apex or top of the dome, between cap 30 and end member 45. Although the sleeve 20 wraps around the pole 40 the tendency is for the nearly single point of contact between the cap 30 and the end member 45 to bear nost of the weight of the device 10 unless the sleeve 20 is in a nearly horizontal orientation. The nearly single point of contact has little area to create drag and since it is on the rotational axis of the sleeve 20 it has almost no lever arm to create a drag torque as the sleeve 30 rotates. This contact creates a minimum of drag between the fixed end member 45 and the rotatable cap 30. Thus if the wind tends to wrap the flag 50 around the device 10, then the weight of the flag 50 is enough to overcome the minimum drag created between the cap 30 and end member 45 such that the device 10 will assume the correct orientation shown in FIG. 1.

The sleeve 20 fits in loose communication with the flagpole 40 so that the sleeve 20 rotates in response to wind force on an attached flag 50. As will be understood, as wind causes the flag 50 to rotate, the sleeve 20 may freely rotate while the flagpole 40 remains stationary.

As shown in FIG. 1, the flag 50 is attached to the flagpole apparatus 10 by retaining means known in the art. In the preferred embodiment, eye screws 60A and 60B are used to attach the flag 50 to the flagpole apparatus 10. The flag 50 includes a top end 52, a bottom end 54, and a side end 56. As shown in the preferred embodiment, eye screw 60A is threadably received within an opening 32A in the end cap 30. In this embodiment, the threaded portion of the eye screw 60A extends through the opening 32A of the end cap 30 and threadably connects the end cap 30 to the sleeve 20 so that rotation of the sleeve 20 simultaneously rotates the end cap 30. Eye screw 60B is threadably received within an opening 37A of the collar 35. The threaded portion of the eye screw 60B extends through the opening 37A of the collar 35 and threadably connects the collar 35 to the sleeve 20 so that rotation of the sleeve 20 simultaneously rotates the collar 35.

As shown in FIG. 1, the flag 50 further includes openings 52A, B. Opening 52A is connected to the loop head portion of the eye screw 60A with attaching means 70 known in the art, such as cable ties, a clip or thin wire. Opening 52B is connected to the loop head portion of the eye screw 60B with similar attaching means 70 known in the art. In particular, and as further shown in FIG. 1, the top end 52 is positioned just below the eye screw 60A and the bottom end 52 is positioned just above the eye screw 60B. In application, the attaching means 70 is of sufficient rigidity and tautness so that the top end 52 of the flag 50 remains disposed below the eye screw 60A and the bottom end 54 of the flag likewise remains disposed above the eye screw 60B (as shown in FIG. 1) regardless of the strength of wind that may contact the flag 50. Further as shown in FIG. 1, the side end 56 of the flag 50 is positioned in approximate abutting relationship with the sleeve 20.

Wind tends to align the flag 50 parallel with wind direction. The flagpole apparatus 10 of the present invention, namely the sleeve 20, the end cap 30, and the collar 35 will tend to rotate responsive to wind force on the attached flag 50, in order to permit the flag 50 to rotate in aligned parallel relationship with the wind. This reduces the tendency of the flag 50 to wrap itself around the flagpole 40.

Further, even if the flag 50 does get wrapped around the device 10 by a strong gust of wind, the center weight of the flag 50 created by the flag 50 wrapping around the device 10 can quickly cause the device 10 to reassume the position shown in FIG. 1 which is the only stable position for the device.

The preferred material of construction of the flagpole apparatus 10 may be metal or plastic. The cap 30 and/or end member 45 can be of a self lubricating material such as nylon.

Although the description above contains many specificities, these should not be construed as limiting the scope of the invention but as merely providing illustrations of some of the presently preferred embodiments of the invention. For example, the end cap 30 and the collar 35 may be separate parts affixed to the sleeve 20, or the collar 35 could be molded as an integral part of the sleeve 20. Further, although the interior surface 30C of the cap 30 is shown as flat and the upper surface of the end member 45 is shown as a dome shape, the device 10 would also work with a variety of other shapes that could produce a near single point of contact. One such arrangement would be a dome shaped surface on the interior of the cap 30 and a flat surface on the end member 45. As such, this invention thus described, may be varied in many ways. Such variations are not to be regarded as a departure from the spirit and scope of the invention, and all such modifications as would be obvious to one skilled in the art are intended to be included within the scope of the present invention.

Thus the scope of the invention should be determined by the appended claims in the formal application and their legal equivalents, rather than by the examples given.

What is claimed is:

1. A rotatable flagpole apparatus comprising:

a sleeve having a top edge, a flagpole having a fixed end member, said fixed end member defining a shoulder, said sleeve disposed around said flagpole, a flag attached to the sleeve, wherein the shoulder is adjacent to the top edge of the sleeve, and a cap on said sleeve wherein said cap is rotatably supported by said fixed end member, wherein said shoulder retains said sleeve from slipping off said flagpole.

2. The flagpole apparatus as recited in claim 1, wherein the end member further includes an upper portion and a lower portion, wherein the upper portion having a width greater than the lower portion.

3. The flagpole apparatus as recited in claim 2, wherein the lower portion of the end member is slidingly received within an opening of an upper end of the flagpole.

4. The flagpole apparatus as recited in claim 3, wherein the flagpole has an axis and wherein a length of the lower portion is on the axis with the flagpole.

5. The flagpole apparatus as recited in claim 2, wherein the upper portion of the end member is dome shaped.

6. The flagpole apparatus as recited in claim 1, wherein at least said flagpole and said sleeve are metal.

7. The flagpole apparatus as recited in claim 1, wherein at least said flagpole and said sleeve are of plastic.

8. A rotatable flagpole apparatus comprising:

a sleeve having a top edge, a flagpole having a fixed end member, said fixed end member defining a shoulder, said sleeve disposed around said flagpole, a cap on an end of said sleeve, a collar affixed to an end of the sleeve opposite the top edge, a first means for attaching a top end of a flag to the cap, a second means for attaching a bottom end of the flag to the collar, wherein the shoulder is adjacent to the top edge of the sleeve, and wherein said cap is rotatably supported by said fixed end member, wherein said shoulder retains said sleeve from slipping off said flagpole.

9. The flagpole apparatus as recited in claim 8, wherein the end member further includes an upper portion and a lower portion, wherein the upper portion having a width greater than the lower portion.

10. The flagpole apparatus as recited in claim 9, wherein the lower portion of the end member is slidingly received within an opening of the upper end of the flagpole.

11. The flagpole apparatus as recited in claim 10, wherein said flagpole has an axis and wherein a length of the lower portion is on the axis with the flagpole.

12. The flagpole apparatus as recited in claim 9, wherein the upper portion is dome shaped.

13. The flagpole apparatus as recited in claim 12, wherein an interior surface of said cap is rotatably supported on an apex of said end member upper portion.

14. The flagpole apparatus as recited in claim 8, wherein the first and second means for attaching are eye screws.

15. A rotatable flagpole apparatus comprising:

a sleeve having a top edge and an outside diameter, a flagpole having a fixed end member, said fixed end member defining a shoulder near a top edge of said flagpole, said sleeve disposed around said flagpole, a first means for attaching a flag to the sleeve, wherein the shoulder is adjacent to the top edge of the sleeve, and a cap on said sleeve wherein said cap is rotatable supported by said fixed end member and wherein said shoulder retains said sleeve from slipping off said flagpole.

16. The rotatable flagpole apparatus as recited in claim 15, wherein said shoulder of said fixed end member retains said sleeve by engaging the top edge of said sleeve.

* * * * *